US006309468B1

(12) United States Patent
Sommer

(10) Patent No.: US 6,309,468 B1
(45) Date of Patent: Oct. 30, 2001

(54) WORKING METHOD AND CLEANING DEVICE FOR CLEANING A SWIMMING POOL

(75) Inventor: Hans-Rudolf Sommer, Schinznach-Dorf (CH)

(73) Assignee: 3S Systemtechnik AG, Remigen (CH)

( * ) Notice: Subject to any disclaimer, the term of this patent is extended or adjusted under 35 U.S.C. 154(b) by 0 days.

(21) Appl. No.: 09/404,204

(22) Filed: Sep. 23, 1999

(30) Foreign Application Priority Data

Sep. 23, 1998 (CH) ..... 1940/98

(51) Int. Cl.[7] ..... B08B 9/00
(52) U.S. Cl. ..... 134/18; 15/1.7
(58) Field of Search ..... 15/1.7, 319; 134/18

(56) References Cited

U.S. PATENT DOCUMENTS

| | | | | |
|---|---|---|---|---|
| 2,988,762 | | 6/1961 | Babcock . | |
| 4,786,334 | * | 11/1988 | Nystrom | 15/1.7 X |
| 5,208,521 | * | 5/1993 | Aoyama | 15/1.7 X |
| 5,256,207 | * | 10/1993 | Sommer | 15/1.7 X |
| 5,435,031 | * | 7/1995 | Minami et al. | 15/1.7 |

FOREIGN PATENT DOCUMENTS

| | | |
|---|---|---|
| 31 10 203 | 9/1982 | (DE) . |
| 0 099 489 | 2/1984 | (EP) . |
| 0 257 006 | 2/1988 | (EP) . |
| 0 483 677 | 5/1992 | (EP) . |
| 2 584 442 | 1/1987 | (FR) . |

* cited by examiner

*Primary Examiner*—Philip R. Coe
(74) *Attorney, Agent, or Firm*—Venable; Norman N. Kunitz

(57) ABSTRACT

A cleaning device (2) which can be moved backwards and forwards in a swimming pool (1) has a drive mechanism which can be switched to forward or backward travel and has one motor for a left-hand-side and one for a right-hand-side part of the drive mechanism and a control apparatus for controlling the drive mechanism. The control apparatus has a speed regulation apparatus for each part of the drive mechanism and has means for differentially controlling the speed of the two motors. The cleaning device has means on both parts of the drive mechanism for measuring the distances ($d_1$, $d_2$) covered in forward and backward travel. The angles ($R_1$, $R_2$) of change of direction are calculated and differentially controlled by the control apparatus on the basis of the measured distances ($d_1$, $d_2$) covered and an offset width (v) of the respective travel tracks. The advantage of the control method lies in the fact that angles of change of direction can be precisely executed and swimming pools of any desired shape can be reliably cleaned.

8 Claims, 2 Drawing Sheets

WORKING METHOD AND CLEANING DEVICE FOR CLEANING A SWIMMING POOL

BACKGROUND OF THE INVENTION

The invention relates to a working method for cleaning a swimming pool using a cleaning device that moves backwards and forwards across the floor of a swimming pool and has a drive mechanism that can be switched to forward or backward travel and is actively connected to drive wheels or drive tracks, a respective motor for each of a left-hand-side and a right-hand side part of the drive mechanism, a control apparatus for controlling the drive mechanism, and contacts arranged at the front and rear to generate control signals in the event that the cleaning device approaches a swimming pool wall or an obstacle. The invention further relates to cleaning device for cleaning a swimming pool for carrying out the method according to the invention.

Cleaning devices moving automatically backwards and forwards on the bottom of the swimming pool have been known for a considerable time. In most cases, however, they have the disadvantage that pools of irregular shapes cannot be cleaned automatically and reliably. Particularly in the low-cost range, there is a need for appropriate simple devices.

DE-3 110 203 describes a method and a device for cleaning a swimming pool which, in a known manner, moves backwards and forwards on the bottom of a water-filled swimming pool and, in doing so, cleans it by suction. The device has two motors, so that the two sides of the drive mechanism can run forwards or backwards or remain stationary independently of each other. The device additionally possesses a control apparatus which is influenced by four sensors arranged at the corners of the device and controls the travel of the device on the bottom of the swimming pool between opposite swimming pool walls in a zigzag path. The device travels alternately forwards and backwards. It does not turn at the swimming pool walls, but performs small pivoting movements there on each occasion. These pivoting movements firstly enable the cleaning device to be aligned relative to the swimming pool wall and secondly allow a new direction of movement to be set subsequently. Since the cleaning device has one motor for each of the two sides of the drive mechanism, one of the two motors is shut down on each occasion in order to achieve the alignment movements and changes of direction, the other motor continuing to run during the alignment operation or during a delay period. As a result, the cleaning device rotates about the shut-down drive part.

One of the disadvantages of this cleaning device resides in the fact that changes of direction can only be performed relatively imprecisely. The achievable accuracy of the angle of change of direction depends on factors which are difficult to control, such as, for example, the different dynamic performance of the two sides of the drive (inter alia, during starting conditions) and the pronounced dependence on the delay period. The consequence of this is that, especially in the case of relatively long travels, the reliable overlap of the cleaning tracks and hence the complete cleaning of the pool bottom may not be guaranteed under certain circumstances. The principle disadvantage, however, resides in the fact that this cleaning device is not suitable for pools of different sizes without careful adjustment of the delay period and is only suitable for rectangular or square pool shapes.

The object of the present invention is therefore to provide a simple method for cleaning and a reasonably priced cleaning device which can be used both in pools of different sizes and in pools of different shapes and guarantee reliable cleaning of the pool bottom.

SUMMARY OF THE INVENTION

The above object generally is achieved, according to a first aspect of the invention, by a method for cleaning a swimming pool using a cleaning device that moves backwards and forwards in the swimming pool and has a drive mechanism that can be switched to forward or backward travel and is actively connected to drive wheels or drive tracks, a respective motor for each of a left-hand-side and a right-hand-side part of the drive mechanism, a control apparatus for controlling the drive mechanism, and contacts arranged at the front and rear to generate control signals in the event that the cleaning device approaches a swimming pool wall or an obstacle; and wherein the control apparatus possesses, for each part of the drive mechanism, a speed regulating apparatus, and means for the differential control of the speed of the two motors; with the method including measuring the distances ($d_1$,$d_2$) covered in forward or backward movement by both parts of the drive mechanism of the cleaning device; and, in the control apparatus, calculating and differentially controlling angles ($R_1$,$R_2$) of change of direction for the travelling cleaning device based on the measured distances ($d_1$,$d_2$) covered and an offset width (v) of the respective travel tracks.

The above object is generally achieved according to a second aspect of the invention by a cleaning device for carrying out the above method; having a drive mechanism which can be switched to forward or backward travel and is actively connected to drive wheels or drive tracks; a respective motor for each of a left-hand-side and a right-hand-side part of the drive mechanism; a control apparatus for controlling the drive mechanism; and a contact means arranged at the front and rear to generate control signals in the event that the cleaning device approaches a swimming pool wall or an obstacle; and wherein: the control apparatus possesses, a speed regulating apparatus for each respective part of the drive mechanism, and means for the differential control of the speed of the two motors; the cleaning device has a means on both parts of the drive mechanism for measuring the distances covered in forward or backward travel; and the control apparatus possesses means for calculating and differentially controlling changes of direction of the travelling cleaning device based on the measured distances covered and an offset width of the respective travel tracks.

The object is achieved, in essence, in that for a left-hand and right hand part of the drive mechanism, means for measuring the distance covered on the pool bottom and means for differentially controlling the motors of the two parts of the drive mechanism at different speeds are used. The initial result of this is that the control apparatus of the cleaning device can automatically and independently calculate the angle of change of direction required for the next cleaning pass and perform the necessary control functions. In particular, however, the effect achieved is that the respective angles of change of direction can be set very precisely and without resorting to high-cost control technology such as, for example, travel-direction sensors.

According to a preferred embodiment of the invention, the control apparatus of the cleaning device is so constructed that a choice can be made between two or more different working programmes. Thus, for example, a first working program can be provided for the cleaning of swimming pools of any desired shape, the cleaning device in this working program undertaking no alignment operations at all at the swimming pool walls. A further working program can, for example, be provided for the cleaning of swimming pools having at least one suitable, linear, reference swimming pool wall, the cleaning device in this working program performing an alignment relative to the reference swimming pool wall on each occasion.

An embodiment of the invention with two working programs of this type is explained in more detail in the following text with reference to the drawings.

DESCRIPTION OF THE PREFERRED EMBODIMENTS

Figure 1:
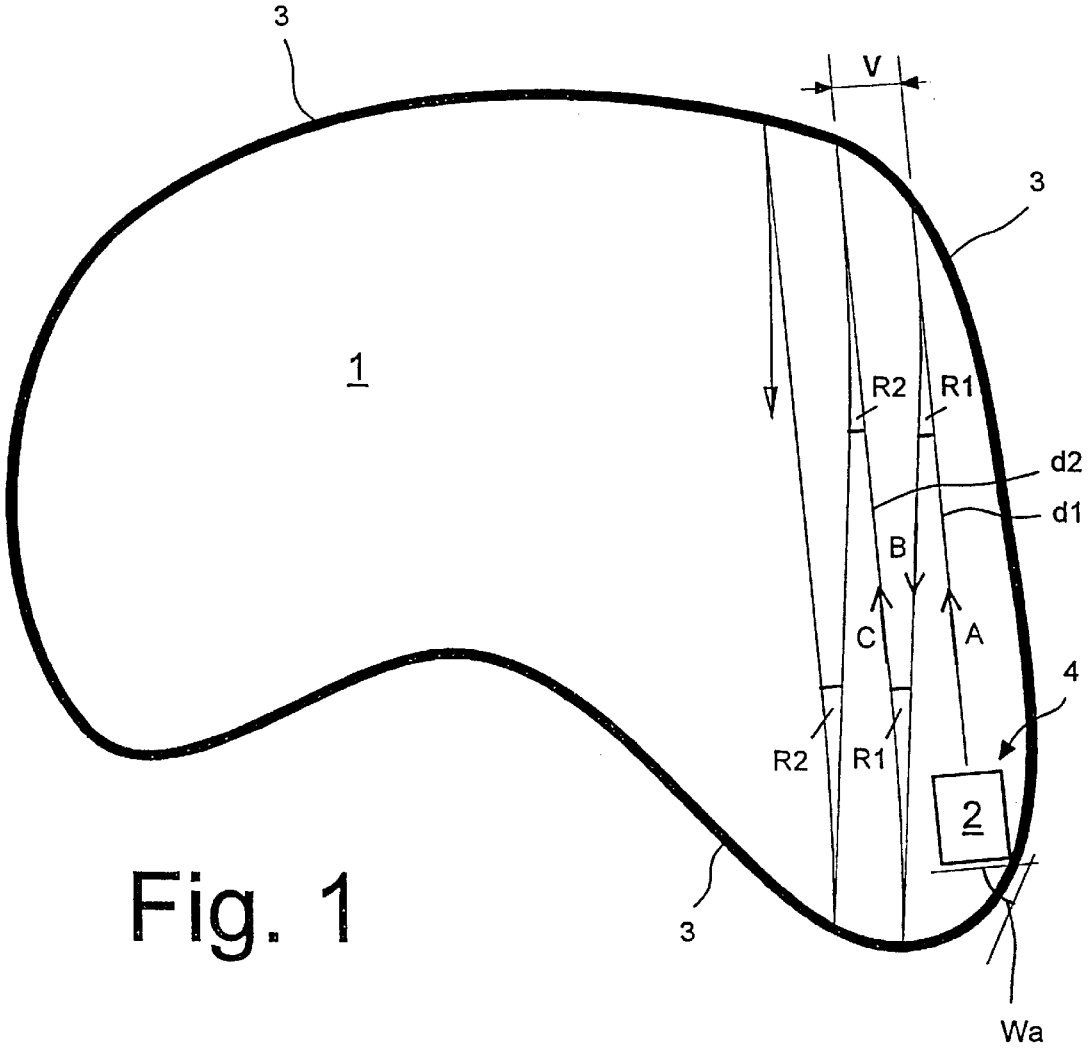
FIG. 1 shows a swimming pool of irregular shape with a diagrammatic course of the cleaning path.
Figure 2:
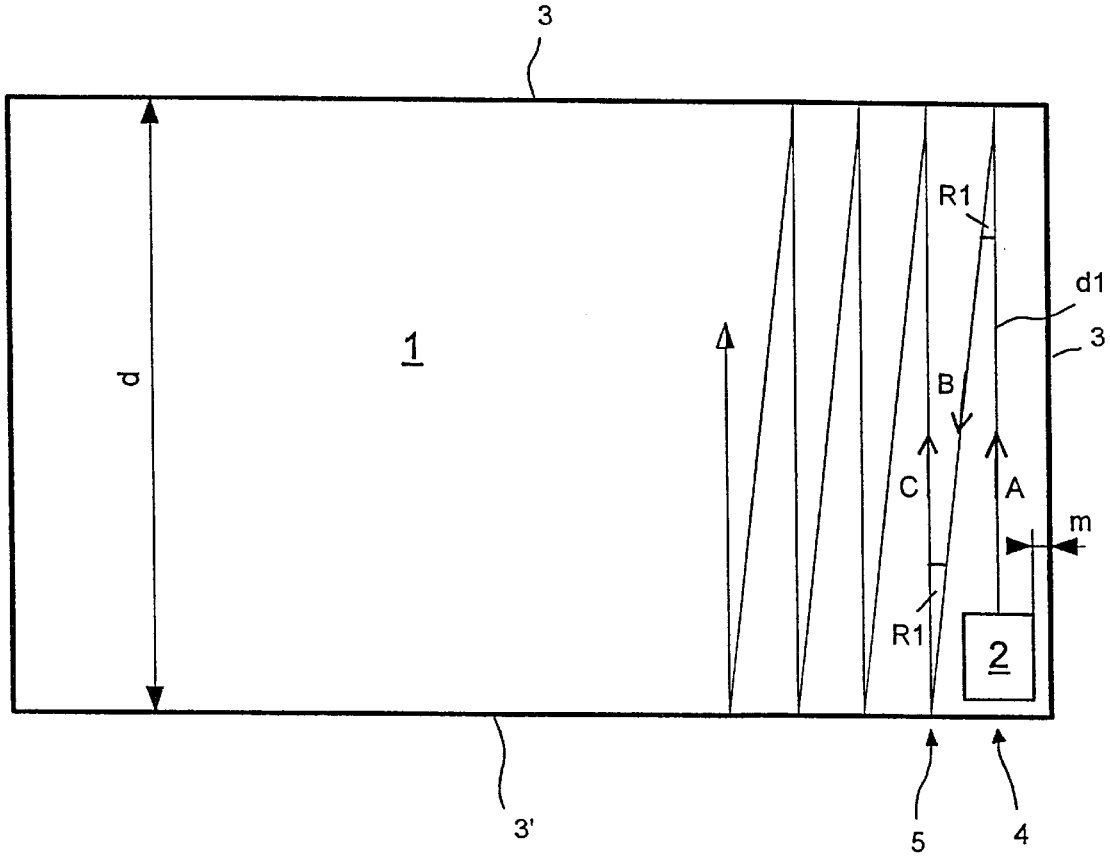
FIG. 2 shows a swimming pool of rectangular shape with a diagrammatic course of the cleaning path.

The cleaning device used in the descriptions that follow, according to FIGS. 1 and 2, has a drive mechanism which can be switched to forward or backward travel and is actively connected to drive wheels or drive tracks. In this arrangement, the drive mechanism has one motor each for a left-hand-side and a right-hand-side part of the drive mechanism. A control apparatus controls the interaction of the motors of the two parts of the drive mechanism. The control apparatus contains separate speed regulating apparatuses to regulate the speed of the two motors. The control apparatus is also designed for differential regulation of the speed of the two motors. This means that the two motors can be operated at different nominal speeds. For straight travel (forwards or backwards) equal nominal speeds are assigned to the two speed regulation apparatuses.

The cleaning device has contact means arranged at the front and rear corners for generating control signals in the event of the cleaning device approaching a swimming pool wall or an obstacle. In a simple form, the contact means may be designed as mechanical switching sensors with relatively long buffer travels (in order to avoid actual collision with the swimming pool wall or the obstacle).

The cleaning device also has means on both parts of the drive mechanism to measure the respective distances covered in forward and backward travel. Preferably, these are pulse generators, arranged on both sides, on the drive wheels (or on the drive wheels acting on drive tracks). The total distance covered can be ascertained on the basis of the relationship, which is known and determined by the design, between the number of rotations (or pulses) per drive wheel and the distance covered resulting therefrom.

FIG. 1 shows a swimming pool 1 of irregular shape with a diagrammatic tracing of the cleaning path according to a first working program. This working program includes no alignment operations of the cleaning device 2 at the swimming pool walls 3.

The cleaning device 2 is started at a suitable point on the swimming pool wall 3, at a starting position 4; in the desired initial direction of travel A. The cleaning device initially travels in this direction in a straight line to the opposite wall. The distance covered by the cleaning device during this movement is continuously measured. On contact with the opposite wall, the contact means arranged on the front of the cleaning device emit a control signal, which causes the drive mechanism to be switched off, before the cleaning device actually collides with the swimming pool wall. With the cleaning device stationary, the control device has access to measured data on the distance $d_1$ most recently covered.

On the basis of the value for the distance $d_1$ most recently covered by the cleaning device, which is now available, and a known offset width v (width of the cleaning track of the cleaning device), the necessary angle $R_1$ of change of direction is now calculated by the control apparatus. As a good approximation, the following applies:

$$\tan(R_1)=v/d_1$$

the result of this is that a reliable overlap of the respective cleaning tracks is ensured even in the event of a constantly changing swimming pool width.

In order to ensure that the change of direction which is now to take place is performed as precisely as possible, the two motors of the two parts of the drive mechanism, after the switch of the direction of travel, are run up together to the nominal speed during a first movement phase with a gentle linear speed increase. This avoids changes in acceleration of the drive which are abrupt and therefore unpredictable in their effects. In a subsequent, second movement phase, the two motors are then operated at constant but different nominal speeds for the duration of the change of direction. Since the distance covered is measured at both parts of the drive mechanism, it is now possible to ascertain the duration of the second operating phase for a particular combination of nominal speeds of the two motors on the basis of the different arc lengths for a particular angle of change of direction which is to be achieved. Preferably, for the duration of the change of direction, one of the motors is brought to a nominal speed which is higher than the nominal speed to be achieved at the conclusion of the operation of change of direction and retained for the crossing of the swimming pool bottom. In this manner, the changes of direction take place in a jerk-free and gentle manner, so that a high degree of stability in movement results. Since each part of the drive mechanism is equipped with an independent speed regulation circuit, high accuracy is achieved.

To complete the operation of change of direction, the two motors are brought to the same nominal speed, whereby the speed most recently achieved is retained for the crossing of the swimming pool bottom. The cleaning device now moves backwards in straight direction B towards the starting wall. On contact with the starting wall, contact means arranged at the rear of the cleaning device generate a control signal, the effect of which is that the drive mechanism is again shut down before the cleaning device actually collides with the swimming pool wall 3.

Since the direction C parallel to direction A is to be taken during the renewed forward travel of the cleaning device, the angle $R_1$ of change of direction previously calculated at the opposite side must be adopted again in the change of direction which is now to take place. The operation of change of direction otherwise takes place in the same manner as described above.

In the renewed forward travel of the cleaning device the distance covered $d_2$ is measured. In the example shown, the distance covered $d_2$ is greater than the first measured distance covered $d_1$. The consequence of this is that, on the next contact with the opposite wall, the newly calculated angle $R_2$ of change of direction is less than the angle $R_1$ of change of direction. This ensures that the cleaning paths of the cleaning device always extend in an overlapping manner.

In order to guarantee reliable functioning, it is merely necessary to ensure that, in each contact position (that position at which the contact means report a contact with the swimming pool wall or an obstacle), a minimum angle of attack $W_A$ should be guaranteed. The magnitude of this angle depends on the contact means used and, in the case of mechanical contact strips, is about 60°. In FIG. 1, the angle of attack $W_A$ is drawn in at start position 4 for the sake of clarity.

FIG. 2 shows a swimming pool of rectangular shape with a diagrammatic course of the cleaning path according to a second working program. This working program includes operations to align the cleaning device relative to a reference swimming pool wall.

This working program can be used for swimming pool shapes in which a suitable straight reference swimming pool wall 3' is available. The rectangular shape shown in FIG. 2 is thus to be understood merely as an example.

In this working program also, the cleaning device 2 is positioned in a start position 4 at a suitable point on the swimming pool wall 3. First, however, it is run backwards in order to align itself automatically and parallel with the reference swimming pool wall 3'. Thereafter, it is launched in the direction A of initial travel.

The forward travel in the start direction A and the backward travel in direction B, together with the calculation and control of the angle $R_1$ of change of direction, take place in exactly the same way as in the working program according to FIG. 1.

When the cleaning device again impacts on the reference swimming pool wall 3' at the second orientation position 5, the cleaning device is, however, again realigned relative to the latter. This has the consequence that the subsequent straight, forward travel in direction C takes place parallel to the original start direction A, a complete overlap of the cleaning tracks again being ensured thereby. Because of the existance of the reference swimming pool wall, therefore, in this case a precisely controlled curved travel is replaced by an alignment operation which is less demanding in terms of control technology.

In order to ensure reliable functioning, it is merely necessary to ensure that a minimum distance m from a swimming pool wall 3 extending at right angles to the reference swimming pool wall 3' is observed. For the device configuration described, the minimum distance m is approximately in the region of 0.2 m. The intention here is to ensure that, even in the case of the maximum distance d, no disruptive lateral contact takes place between the cleaning device and the swimming pool wall (to allow for alignment errors).

In order to produce a cleaning device according to the invention, the following components are advantageously employed:

The two motors of the drive mechanism parts are preferably electrical drives, the motors in each case acting non-positively via reducing gears and drive wheels on drive belts arranged on both sides. For reasons of optimum weight distribution, the drive units are arranged symmetrically at the front and rear. For the purpose of simple regulation, direct current motors with revolution counters are preferably used. Electronic motor regulators convert the pulses and command signals analysed by the control apparatus into electrical correcting variables.

The nominal motor speed or nominal speed of travel preset by the control apparatus is passed to the respective motor regulators. For each of the two drives, the actual speed of rotation or actual speed of travel is recorded separately via the revolution counter and again passed to the respective motor regulators. Thus each drive has its own speed regulation circuit, in which the nominal and actual values are compared and precisely adjusted.

As already mentioned, slipping of the drive belts when the drive is started is prevented by the two motors being gently run up together in a linear run-up pattern defined by the control apparatus.

What is claimed is:

1. A method for cleaning a swimming pool using a cleaning device that moves backwards and forwards in the swimming pool, and has a drive mechanism that can be switched to forward or backward travel and is actively connected to drive wheels or drive tracks, a respective motor for each of a left-hand-side and a right hand-side part of the drive mechanism, a control apparatus for controlling the drive mechanism, and contact means arranged at the front and rear to generate control signals in the event that the cleaning device approaches a swimming pool wall or an obstacle, and wherein the control apparatus possesses, for each part of the drive mechanism, a speed regulating apparatus and means for the differential control of the speed of the two motors, said method comprising individually measuring the respective distances ($d_1$,$d_2$) covered in forward or backward movement by each part of the drive mechanism and, using the control apparatus, calculating and differentially controlling angles ($R_1$, $R_2$) of change of direction for the travelling cleaning device based on the measured distances ($d_1$, $d_2$) covered and an offset width (v) of the respective travel tracks.

2. The method according to claim 1, further comprising, for the performance of changes of direction of the travelling cleaning device, operating the two motors at constant but different nominal speeds for the duration of the change of the direction.

3. The method according to claim 2, further comprising controlling the magnitude of the angle ($R_1$, $R_2$) of change of direction by changing at least one of the following dependent parameters, (a) the different nominal speeds of the two motors and (b) the period for which the two motors are operated at different nominal speeds.

4. The method according to claim 3, where in the method further comprises triggering an operation of change of direction after contact is made with a swimming pool wall by one of the contact means for generating control signals arranged at the front and rear; and wherein the triggering includes: first stopping the cleaning device and switching the direction of travel, in a subsequent first movement phase, accelerating the two motors via a linear speed increase, and in a second, subsequent movement phase, operating the two motors at constant but different nominal speeds for the duration of the change of direction, and concluding the operation of change of direction by bringing the two motors to the same nominal speed, and retaining the speed finally reached in order to cross the bottom of the swimming pool.

5. The method according to claim 4, further comprising, for the duration of the change of direction, bringing one of the motors to a nominal speed which is higher than the nominal speed to be achieved at the end of the operation of change of direction and retained for the crossing of the swimming pool bottom.

6. The method according to claim 1, further comprising aligning the cleaning device with a swimming pool wall at least at the beginning of operation.

7. The method according to claim 6, further comprising controlling the cleaning device by a program that can be set at the control apparatus so that, at each reference wall of the swimming pool, the cleaning device automatically aligns itself relative thereto.

8. A cleaning device for carrying out the method according to claim 1, comprising a drive mechanism that can be switched to forward or backward travel and is actively connected to drive wheels or drive tracks; a respective motor for each of a left-hand-side and a right-hand-side part of the drive mechanism; a control apparatus for controlling the drive mechanism, and contact means arranged at the front and rear to generate control signals in the event that the cleaning device approaches a swimming pool wall or an obstacle; and wherein the control apparatus possesses a speed regulating apparatus for each part of the drive mechanism, and means for the differential control of the speed of the two motors; the cleaning device has means on both parts of the drive mechanism for measuring the distances covered in forward or backward travel; and the control apparatus possesses means for calculating and differentially controlling changes of direction fo the travelling cleaning device based on the measured distances covered and an offset width of the respective travel tracks.

* * * * *